US005498220A

United States Patent [19]

Ensmenger

[11] Patent Number: 5,498,220

[45] Date of Patent: Mar. 12, 1996

[54] TOE-ARTICULATED STILT

[76] Inventor: Gary Ensmenger, 7111 Gardner St. #7, Winter Park, Fla. 32792

[21] Appl. No.: 261,908

[22] Filed: Jun. 15, 1994

[51] Int. Cl.[6] ..... A63B 25/00

[52] U.S. Cl. ..... 482/76; 482/75; 623/28

[58] Field of Search ..... 623/28; 482/75, 482/76, 148

[56] References Cited

U.S. PATENT DOCUMENTS

| | | | |
|---|---|---|---|
| 1,613,535 | 1/1927 | Root | 482/75 |
| 3,346,882 | 10/1967 | Wilhoyte | 623/28 |
| 3,902,199 | 9/1975 | Emmert | 623/28 |
| 4,449,256 | 5/1984 | Prueitt | 482/75 |
| 4,570,926 | 2/1986 | Ensmenger | 482/75 |

*Primary Examiner*—Stephen R. Crow
*Assistant Examiner*—Jerome Donnolly
*Attorney, Agent, or Firm*—Eric P. Schellin

[57] ABSTRACT

An improved toe-articulated stilt is described wherein there are at least three vertically oriented parallel support columns and a plurality of journaling components to allow at least a two piece foot support to control at least a two piece base which contacts the ground responive to the positioning of the foot support components. Calf leg embracing upright columns are articulately journalled to bracket connecting the two rearmost vertical support columns and terminate at substantially the top of the calf of a leg an is connected by a calf engaging cushioned strap.

8 Claims, 8 Drawing Sheets

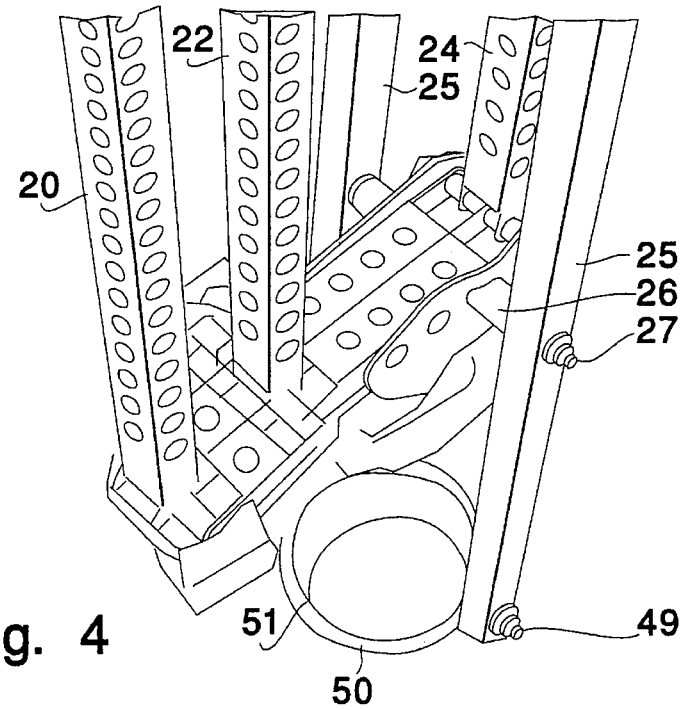
Fig. 4
Fig. 5
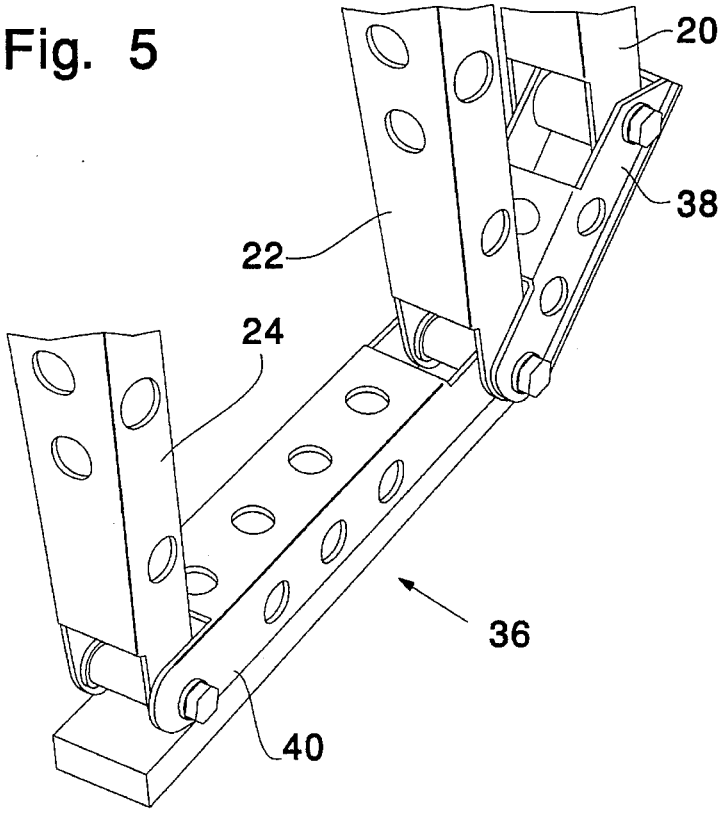

TOE-ARTICULATED STILT

FIELD OF THE INVENTION

This invention relates to improved stilts which may be used in orchards, for entertainment, painting plastering and other work requiring enchanced height, where height and mobility are required. The stilts may also be for orthopedic correction and in athletics.

BACKGROUND OF THE INVENTION

Crude stilts have been used for hundreds of years. The stilts used in many applications by orchard workers, painters and plasterers are relatively crude due to a number of misconceptions relating to design goals. For instance, U.S. Pat. No. 568,557 to Avery and U.S. Pat. No. 2,292,074 to Hawk are examples of the misconception that a very broad base is desirable for stability and safety. U.S. Pat. Nos. 2,802,217 to Wilhoyte, 3,058,120 to Smith, 3,346,882 to Wilhoyte and 3,902,199 to Emmert illustrate the misconception that articulated stilts require springs to achieve natural feel and safe function. U.S. Pat. Nos. 76,465 to Jordan and 1,613,535 to Root illustrate the belief that curved members can be employed and still retain strength.

A prior patent to the present applicant, namely, U.S. Pat. No. 4,570,926, incorporated herein in its entirety by reference, teaches that lightness, strength and natural feel can be combined to produce stilts on which one can dance do acrobatics and work long hours without fatigue. A wide base is clumsy and self defeating. Elaborate mechanisms with springs add needless weight. Curved members cause loss of strength which loss must be compensated for with larger, heavier members. Except for the stilts taught in U.S. Pat. No. 4,570,926, all examples of the prior art are too heavy, too clumsy and have an unnatural feel resulting in fatigue and discouragement of the wearer.

SUMMARY OF THE INVENTION

The goal of this invention is to describe an improved lightweight, safe, strong stilt which has a natural feel allowing the user to work long hours on stilts without undue fatigue and which can be used as an orthopedic correction device.

The goal is accomplished by keeping the various vertical supports straight so that such supports can be as light as possible. The footholder is articulated in two pieces and the base is cooperatively similarly articulated in two pieces. The vertical supports directly supporting the footholder are arranged in three vertical column in a row horizontally displaced from each other so that the motion of the articulated footholder is uniformly transmitted to the articulated base. The base thereby being able to follow the motion of the foot and leg resulting in a natural feel to the user. As a matter of fact the base may be somewhat narrower than the footholder whereby when the stilt is used on a hard surface, a trained user is permitted considerable freedom to dance and to do athletic feats.

The stilt of this application and of the prior issued U.S. Pat. No. 4,570,926 demonstrate a superiority of the toe-articulated stilt in transmitting a natural feel to the wearer. The toe-articulated stilt is the most orthopedically correct design leading to less muscle fatigue and higher confidence of the wearer in safety and security on these stilts. The improved control and self-confidence achieved in turn leads the wearer to attempt feats which have been heretofore impossible on stilts such as dancing, athletics etc. Importantly, due to the increased control fewer injuries will result.

It will be apparent that the toe-articulated stilt can be manufactured in different models for different purposes. Safe inexpensive models can be made as toys. Highly customized models can be used as therapeutic devices for the disabled. Light duty models can be made for athletics and such a sport as fishing. Occupational models can be made for printers, window washers, plasterers, dancers, public speakers, police crowd control and agricultural work.

There is, of course, particular potential for the present toe-articulated stilt in orchard work. The use of ladders and conventional stilts is tiring, time consuming, dangerous and limiting in the ability to reach the center of fruit trees. It can be shown that the use of the toe articulated stilt can result in fruit picking which progresses at three to five times the rate of conventional techniques and pruning can progress at ten times the rate of conventional techniques.

Primary improvements in the present invention over that shown in the earlier U.S. Pat. No. 4,570,926 is in the structure of the leg embracing side members which do not extend to the base but terminate intermediate the footholder and the base and has its ends articulatedly connecting to a respective cross piece which connects the two rearwardly positioned columns. Another improvement is in the provision of a footholder which has unique shoe retaining capabilities. Also of note is the use of a more comfortable leg retainer pad.

These and further constructional and operational characteristics of the invention will be evident from the detailed description given hereinafter with reference to the figures of the accompanying drawings which illustrate preferred embodiments and alternatives by way of non-limiting examples.

BRIEF DESCRIPTION OF THE DRAWINGS

FIG. 4 is a fragmentary perspective view of the footholder portion in an upside down position.

FIG. 5 is a fragmentary perspective view of the base.

DESCRIPTION OF THE PREFERRED EMBODIMENT

Figure 1:
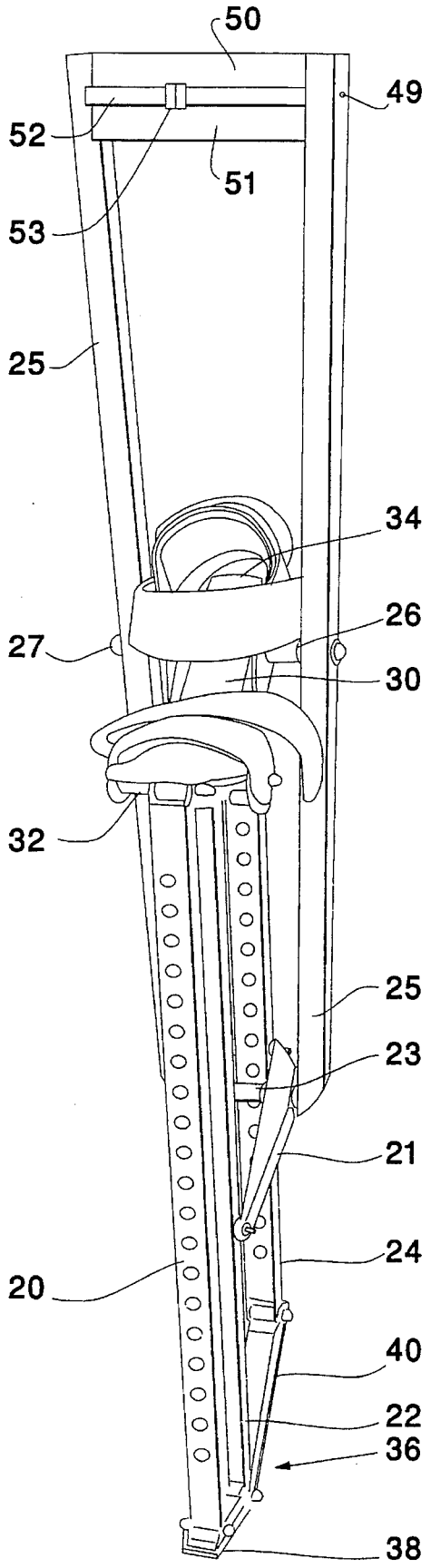
FIG. 1 shows a quarter-front view of the preferred embodiment with the novel leg and foot attaching devices.
Figure 2:
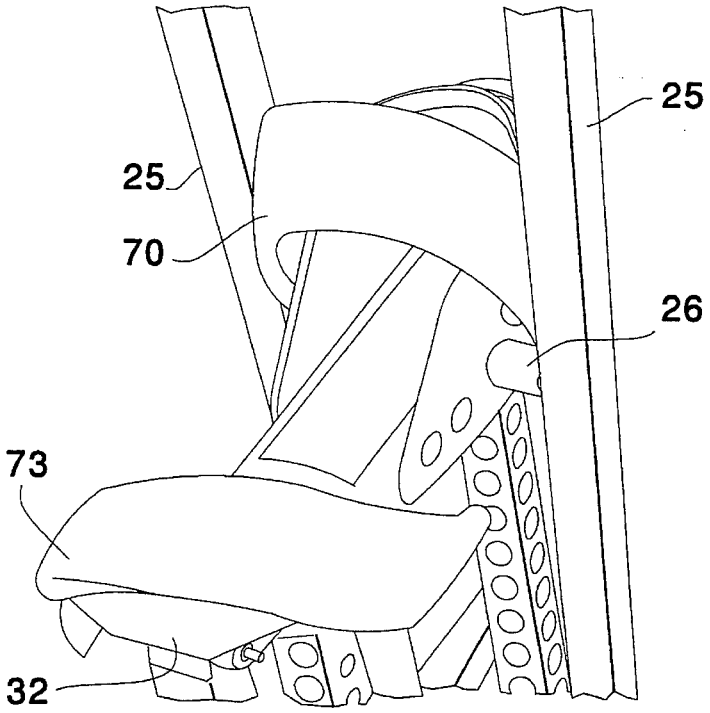
FIG. 2 is a close up fragmentary front perspective view the footholder portion of the stilt.

Referring now to the drawing wherein reference numerals are used to designate parts throughout the various figures thereof, there is shown in FIG. 1 the preferred embodiment of the improved toe-articulated stilt. There are three support columns, the toe column 20, the sole column 22 and the heel column 24. The footholder 30 is formed in two major pieces, i.e., the toe holder 32 and the heel holder 34. Similarly the base 36 is in two major corresponding pieces, the toe base 38 and the heel base 40.

Horizontally disposed brackets 21 are journally attached to each side of the sole column 22 and the heel column 24 intermediate the footholder 30 and the base 36. Both brackets 21 are attached by rotable pivot 23 located between the sole column 22 and the heel column 24 but closer to the heel column 24 than the sole column 22. The rotable pivot 23 extends horizontally outwardly to which the respective lowermost ends of leg embracing columns 25 pivotally is attached. The leg embracing columns 25 extend upwardly and terminates above the footholder 36 and is customized for height whereby it terminates just below the knee of a user. The columns 25 are also journally attached at pivot point 26 to each side of the heel portion 34 of the footholder 36 by means of a suitably disposed axle 27 in the heel portion 34. It will be seen that because pivot 23 is of a shorter length than the axle 27, the columns 25 describe a V-shape as they extend upwardly.

The uppermost portion of the columns 25 are connected by a padded adjustable calf holder 50 which is suitably journalled to pivots 49 therefor to the calf holder 50 encompasses a somewhat arcuate rotation. The padded collar 50 comprises an overlapping cushion portion 51 which is encompassed in a horizontally disposed belt 52 which may be of leather and is secured by a buckle 53 adjustable at the front of the calf of a user in a conventional fashion. The cushion portion 51 is of a foamed polyurethane material and is covered with a thermoplastic film to give the cushion portion 51 rounded edges for both stability and smoothness.

It will be seen from the foregoing that there are ten structural hinged points or journally points. As the stilt has the ability to move because of such journallings the stilt can describe a parallelogram wherein the columns 20, 22, 24 and leg embracing 25 columns remain parallel to one another and the footholder 30, brackets 21 and the base 36 remain parallel. When downward or upward toe action taken by the user toe column 20 continues to be parallel to the other aforementioned columns while the toe holder 32 of the foot holder 30 and the toe base 38 of the base 36 are parallel to each other and the heel holder 34 heel base 40 and brackets 21 are now parallel only to each other. As the toe holder 32 and therewith the toe base 38 moves away from their respective planes with their respective heel holder 34 and heel base 40 the toe column 20 will move closer to the sole column 22 but they will retain their parallelism.

It should be noted that the various structural elements to define a parallelogram, the columns 20, 22 and 24 must be of similar length and the footholder and the base must be of similar length; at least, if not, then the journalling or pivots must be equi-spaced in the footholder and base and as well as the columns 20, 22 and 24.

The heel of the heel holder 34 should be as narrow as possible for comfort to permit the V-shaped construction of the leg embracing columns 25 which are straight. The use of straight materials gives the most strength for the least weight. The two columns 25 on both sides of a calf are important to the wearer, because beyond the strength they impart, the two supports afforded thereby hold the calf holder 50 firmly giving the wearer a feel of confidence in support. A single support would permit the calf holder 50 to be too loose and would move in two planes. A single support would require the wearer to tighten the calf holder 50 to the point of discomfort.

The materials of construction can be aluminum or magnesium square tubing. The choice of materials depend on tradeoffs of strength, weight, cost and ease of fabrication. The weight may be decreased by boring a series of openings in the support columns as desired.

It has been found that bushing should be positioned suitably at all journalled or pivot points whereby to isolate the respective axles from the metal tubing both to avoid no metal to metal touching of moving parts and to avoid any kind of metal electric grounding. The journalling should be sufficiently tight so that no twisting is possible. The bushing material should be a firm shock absorbing material. Brass or vinyl are not suitable for the bushings since these materials can shatter. An example of bushing material suitable for manufacturing to modest tolerances would be nylon, Teflon and Dieldrin.

As was stated the foot holder 30 and the base 36 should be the same length as the foot in order to place the journalling points at natural positions. The toe column 20 should be as far forward as possible. The heel column 24 should be directly under the wearer's heel whereby the heel column 24 and the calf of the wearer describe a straight line.

For toe-articulate stilts to be used on a hard surface, it is important to use a sole of rubber on the base 36 to prevent slipping. Toe-articulated stilts used on soft ground can include cleats or an enlarged base 36 as is suitable to the application.

Figure 10:
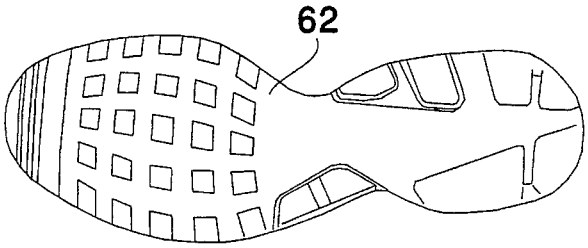
FIG. 10 is a view of the removable bottom portion of the shoe applicable for use with the present improvement.
Figure 11:
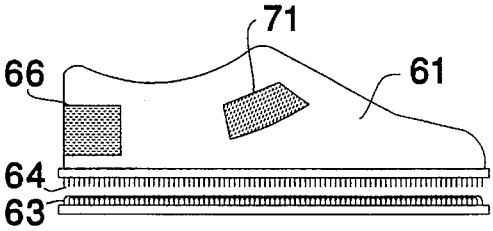
FIG. 11 is a schematic side view of the shoe and attachment.

Besides the afore described modification over the leg columns of the U.S. Pat. No. 4,570,926 for the leg embracing columns 25 there are some additional features that bear consideration, namely, the arrangement for retaining the shoe of a person on the foot holder 30. To accomplish this satisfactorily a conventional athletic shoe 61 is modified. FIG. 10 shoes a normal floor cleated engaging sole 62 therefor. The bottom surface of the shoe is affixed with a surface of one surface of a Velcro-like fastener 63, i.e. a hook and loop fastener, and the side of the sole opposite to the cleated side is affixed with the other surface of a Velcro-like 64 fastener. Such a configuration permits the to-be-stilt walker to use a usual sport shoe with the sole attached when not using a stilt.

Figure 3:
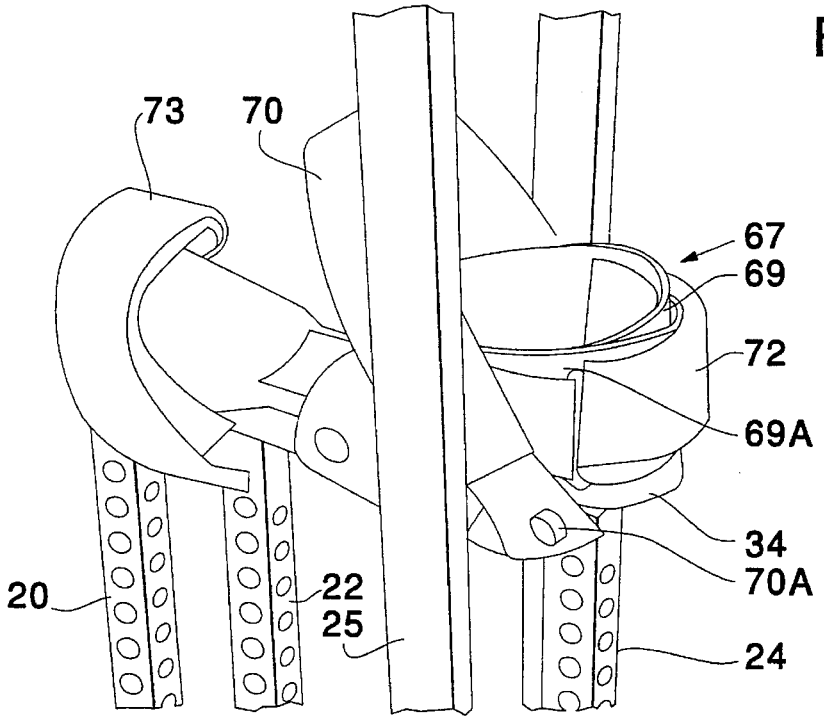
FIG. 3 is a close up fragmentary side perspective view of the footholder portion of the stilt.
Figure 6:
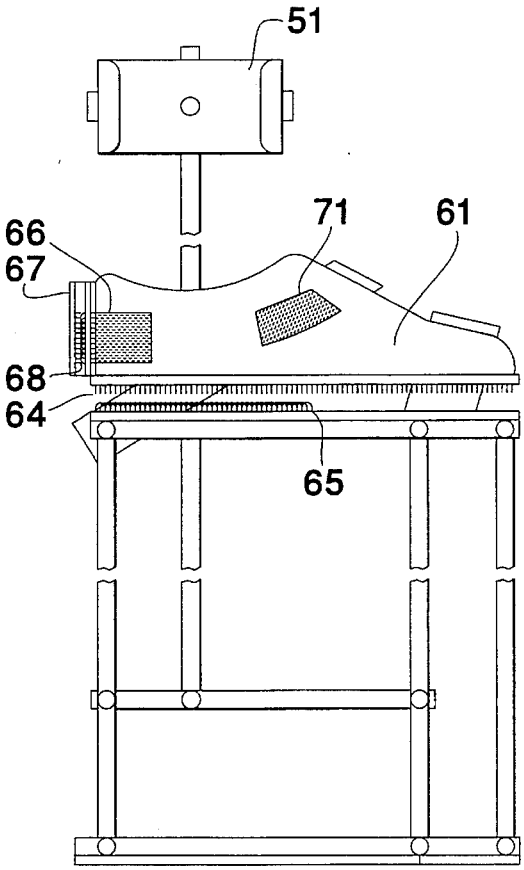
FIG. 6 is a side schematic view of the footholder having a shoe positioned for placement therein.
Figure 8:
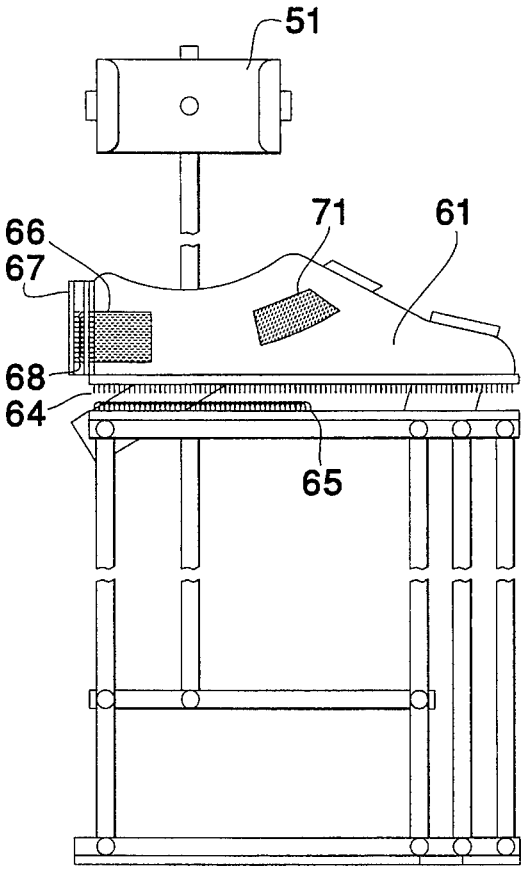
FIG. 8 is a side schematic view of another embodiment of the footholder portion as in FIG. 6.

Then when the stilts are to be used the to-be stilt walker disengages the role 62 and places the still shod foot in the foot holder 30 which has a mating Velcro-like surface portion 65 to the rear of the foot holder, i.e. to the rear of the metatarsal portion, whereby the shod foot is affixed to the foot holder. The rear of the shoe also has Velcro-like fastener portion 66 to which is affixed to upstanding adjustable wings 67 describing arcs detailed to adjustably embrace the shoe at its Velcro-like fastener 66 with a complementary Velcro-like fastener 68 internally of the wings 67. The wings 67 can be seen more clearly in FIG. 3 from which it can be seen that the wings 67 comprise a first portion 69 going from one side and around the back of the shoe (not in place). The other portion 69A goes from the other side and also around the back and around the first portion 69. By employing two pieces for the wings 69 and 69A the shoe heel embracing area is adjustable. Arm adjustable Velcro-like strap 70 is detailed to go over the shoe top and is secured at its ends to the rear portion of the foot holder 70A. To facilitate the immobilization of the shoe, Velcro-like fasteners 71 are positioned an both sides of the side of the shoe 61 to be engaged by strap 70. Still another Velcro-like fastener strap 72 is positioned to engage the outside exposed areas of the wings 69 and 69A to more securely rigidify and hold the said wings than would be possible with just the Velcro-like fastener between the wings 69 and 69A. Finally the front tie portion of the shoe is embraced and held by a Velcro-like fastener strap 73. The end portions thereof is secured to the opposite sides of the foot holder 30. The securement is offset so that at the side where the shoe has the big toe, the end of the strap 73 is further to the front than the side having the smallest toe or opposite.

Figure 7:
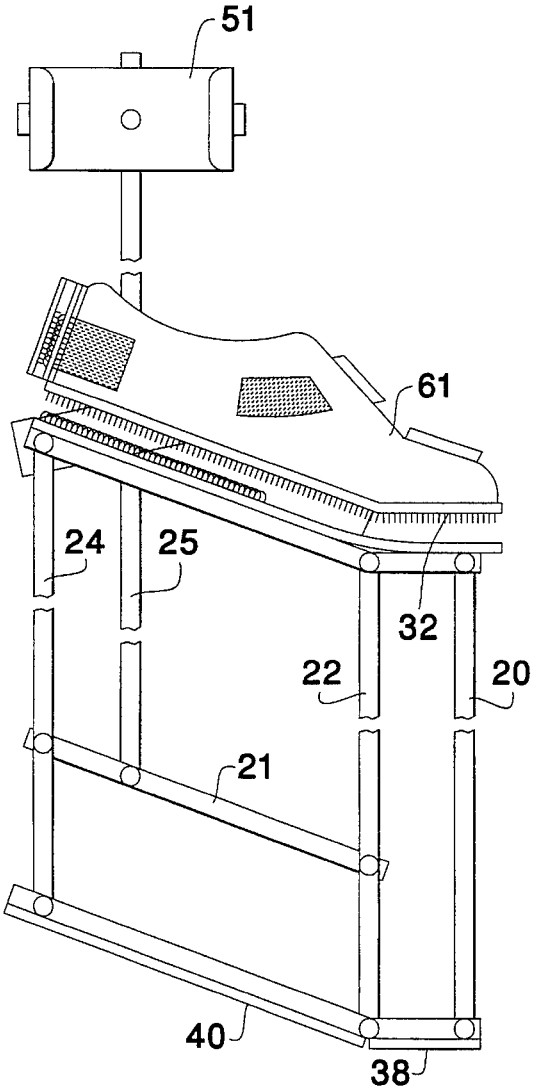
FIG. 7 is a similar view as in FIG. 6 demonstrating articulation of the toe portion.

FIG. 7 is illustrative of the toe bending upwardly thereby changing the plane of both the toe holder 32 and the toe base 38.

Figure 9:
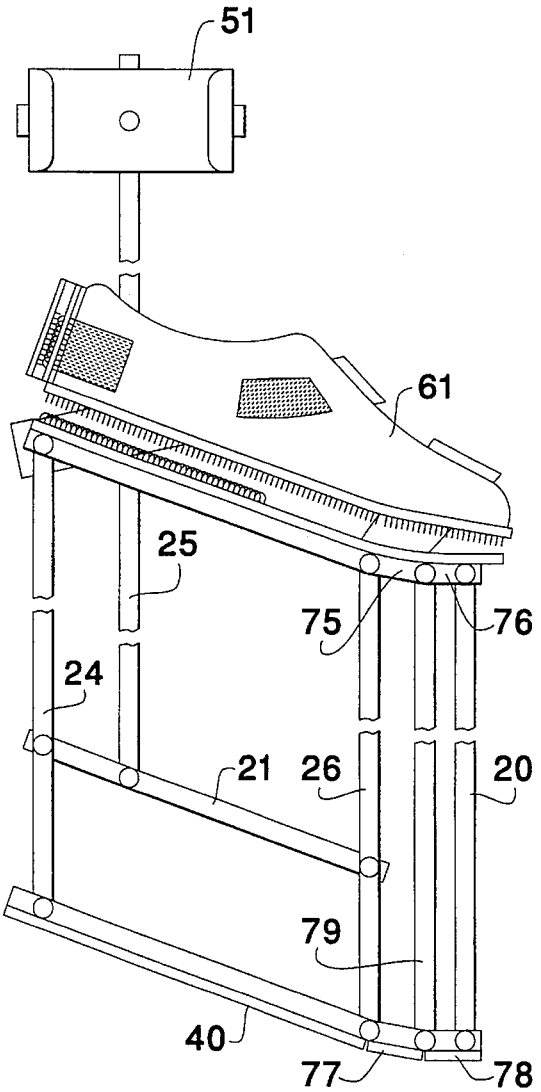
FIG. 9 is a side schematic view of said other embodiment of the footholder as in FIG. 7.

On the other hand FIG. 9 is illustrative of a toe holder that is in two parts 75 and 76 whereby a smoother toe action can be facilitated. Conversely, this embodiment also has two toe bases 77 and 78. Am intermediate support column 79 is provided. The latter is suitably journalled at its end portion as with regard to support columns, namely toe column 20 and sole column 22.

FIG. 5 depicts the lowermost portion of the stilt showing narrow rubber walking surfaces 80 on the heel base and 81 on the toe base. Besides wider strips it is contemplated that such may be replaced by articulated or un-articulated roller blades or by articulated or unarticulated ice blades whereby the stilts can be usefully employed in additional unsual activities.

FIG. 4 is a view of the underside showing in more detail the calf holder 50 which is a split wrap around cushion 51.

Figure 13:
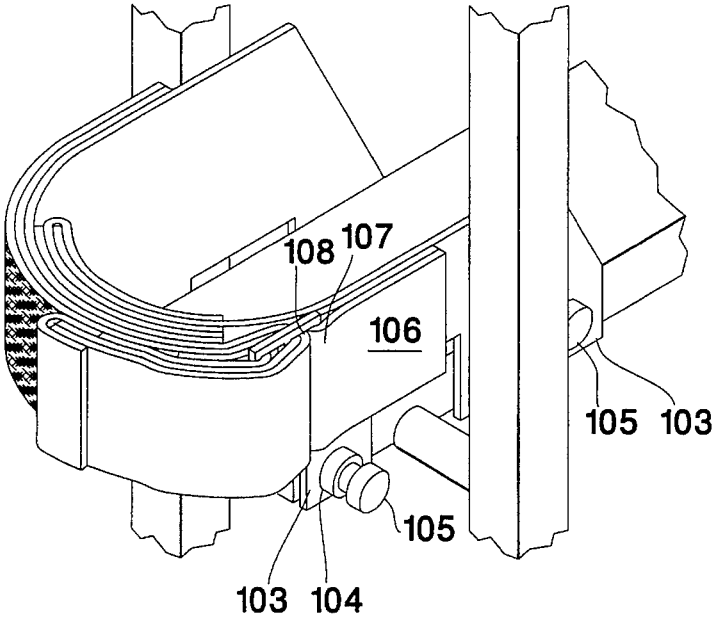
FIG. 13 is a similar view as FIG. 12 with the retainer means being in a bound position.
Figure 14:
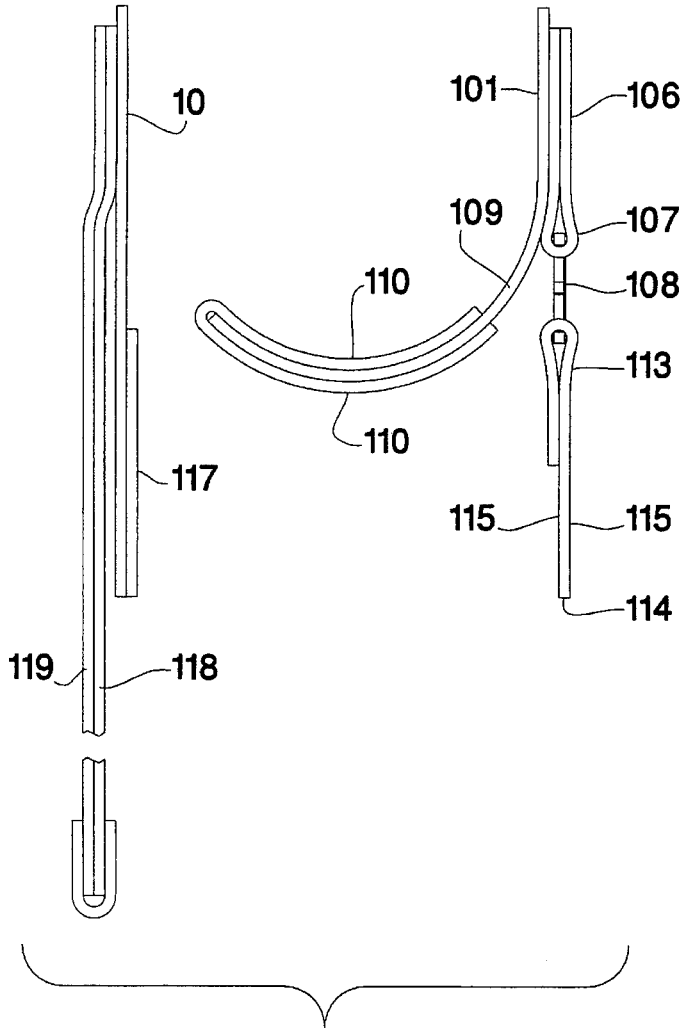
FIG. 14 a top plan view of FIG. 12.
Figure 15:
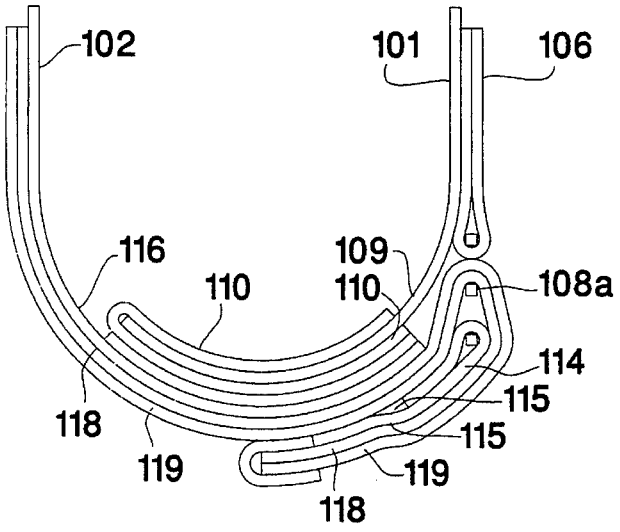
FIG. 15 is a top plan view of FIG. 14.

Attention is now directed to another embodiment of the shoe retainer of the present invention wherein different sized shoes may be accommodated. This embodiment is exemplified by FIGS. 12–14. In this embodiment one can see the shoe retaining means 100 that is used to retain a right shoe (not shown).

The shoe retainer means comprises two separate flexible side pieces, a first right side piece 101 and a second left side piece 102. Each side piece has depending tabs, a first forward tab 103 and an aft depending tab 104. Suitable grommeted holes are provided through the tabs for bolt fixation means 105 for mounting to each side of the shoe or foot support means.

Appropriate straps are secured to the rearward extending portions of each of the flexible side pieces. For instance first flexible strap 106 is sewn at one end to the mid portion of right side piece 101 at proximate the top most portion thereof. The first flexible strap 106 terminates in vertically disposed loop 107 which embraces one vertical portion 111 of a slide 108 having a centrally located rib 108*a*. The first side piece 101 has a rearwardly extending portion 109 which has loop elements 110 of a Velcro hook and loop fastener on both sides of the extension 109.

The opposite vertical portion 112 of the slide 108 has a looped portion 113 of a strap 114 which has on both sides thereof a hooked portion 115 of a Velcro fastener.

The left side piece 102 has a rearwardly extending part 116 which as an inwardly facing hook portion 117 of a Velcro fastener.

Figure 12:
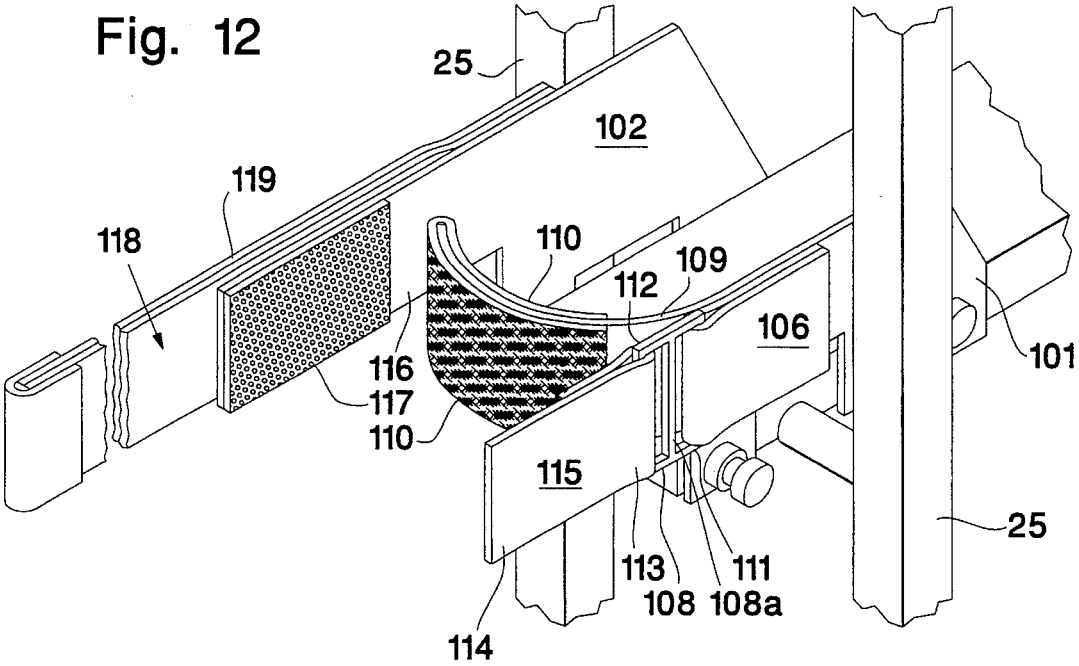
FIG. 12 is an isometric view of another embodiment of retaining means for holding the rear portion of a shod foot in its open position.

A strap 118 has one end affixed externally to the left side piece 102 at its proximate mid section thereof. The strap 118 is quite elongated and in FIG. 12 is seen to extend beyond rearwardly extending part 116. The strap 118 has loop portion 119 of a Velcro fastener facing outwardly thereof.

In assembly, the inwardly facing loop portion of the Velcro fastener of extension 109 is brought into affixing contact of a strip of hook portion of a Velcro fastener which has been affixed to the heel portion of a shoe (not shown). Then the extending part 116 of the left side piece 102 is brought into contact with the extension 109 whereby the hook portion 117 of the Velcro fastener is in affixing abutment with the outwardly extending portion of the loop fastener 110 of the extension 110.

Then, extending part 116 has its end payed through the slide 108 to embrace outwardly rib 108a thereof. The strap 114 is then folded back onto extending part 116 and one side of is hook portion 110 of its Velcro fastener comes into affixing abutment of the outwardly facing loop portion 119 and the hooked portion 115 comes into adhering contact with the loop portion of extending part 116 as a portion thereof is folded around the rib 108*a* of the slide 108, thereby rib 108*a* keeps the straps apart until the proper sizing has been accomplished.

It will be seen that because of the multiple folding of the various traps and extensions the shoe is securely fitted to the stilt and still various adjustments may be achieved.

The straps for strength purposes are constructed of nylon and are similar to the straps used in seat belts for automobiles.

While the foregoing has been primarily covered with the right side of the retainer means, the left side is a mirror image thereof.

Figure 16:
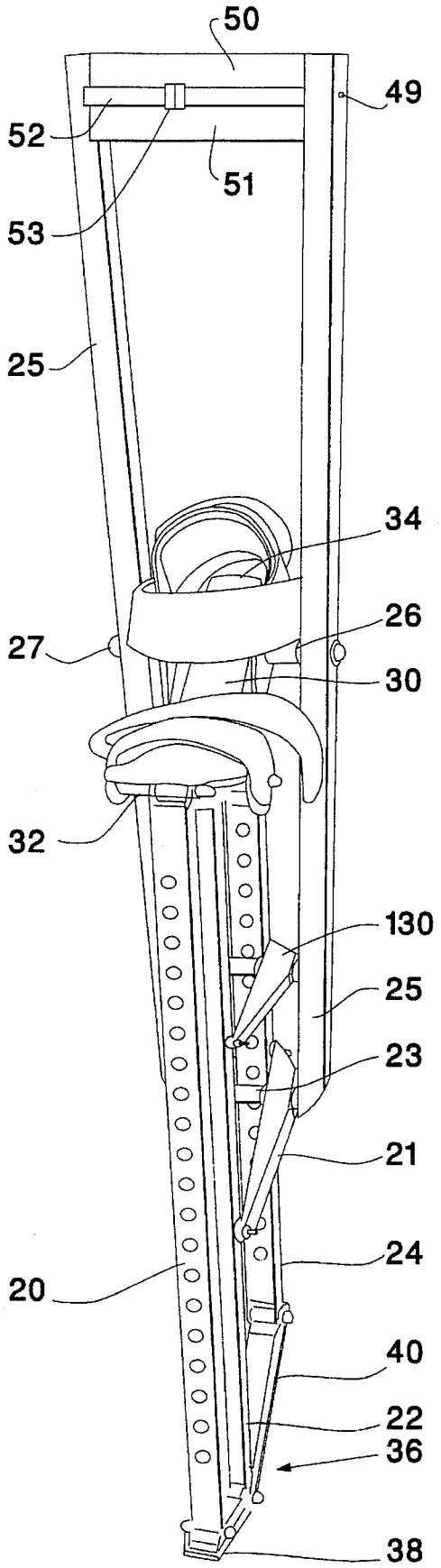
FIG. 16 for another embodiment.

In FIG. 1, for instance, and in FIGS. 7 and 9, diagrammatically, one can see the pivotally mounting of the lowermost end portions of columns 25 which are journally attached to horizontally disposed bracket 21. Attention is directed to schematic and fragmentary FIG. 16. The bracket 21 is journalled to heel column 24 and the other end is journalled to sole column 22. It is also contemplated in another embodiment that an intermediate horizontally disposed "H" bracket 130 is positioned between the footholder 30 and bracket 21. The bracket 130 is journalled at one end to heel column 24 and at its other end to sole column 22. The bracket 130 is also journalled intermediate its ends to columns 25.

This invention is not limited to the preferred embodiments and alternatives heretofore described, to which variations and improvements may be made, consisting of mechanically equivalent modifications to component parts without leaving the scope of the present patent, the characteristics of which are summarized in the following claims.

What is claimed is:

1. A toe-articulated stilt comprising:

a toeholder means, a heelholder means hinged with a first hinge means to said toeholder means such that the combination of said toeholder means and said heelholder means fit the sole of the foot of the wearer when said stilt is worn, a heelbase means, a toebase means hinged with a second hinge means to said heelbase means, a toecolumn, one end of which is hinged with a third hinge means to the forward end of said toeholder means, the other end of which is hinged with a fourth hinge means to the forward end of said toebase means, a solecolumn, one end of which is hinged with a fifth hinge means to the forward end of said heelholder means, the other end of which is hinged with a sixth hinge means to the forward end of said heelbase means, a heelcolumn one end of which is hinged with a seventh hinge means to the rear end of said heel base means, the other end of which is hinged with an eighth hinge means attached to the rear end of said heelholder means, two oppositely disposed bracket means one end of each of which is hinged with a ninth hinge mean to the said heel column intermediate its ends and the other ends each of which is hinged with a tenth hinge means to the said sole column intermediate its ends, said brackets being positioned to be substantially parallel to the heel holder and the heel base, a vertical upstanding column means extending from said each bracket to above a position substantially above said heel holder means wherein the lower one end of each is hinged with a eleventh hinge means to one of the said brackets, and each of said vertical upstanding columns are also hinged at an intermediate point with a twelfth hinge means to said heel holder, the vertically upstanding column means extending above said heel holder terminating in calf leg engaging flexible band adapted and constructed to engage the calf of the user of the stilt.

2. A toe-articulated stilt as in claim 1 wherein the calf leg engaging flexible band is pivotally secured to the vertically upstanding columns.

3. A toe-articulated stilt as in claim 1 wherein the distance between the third hinge means and the fourth hinge means, the distance between the fifth hinge means and the sixth hinge means, and the distance between the seventh hinge means and the eighth hinge means are equal.

4. A toe-articulated stilt as in claim 3 wherein the distance between the first and second hinge means is equal to the distance between the fifth and sixth hinge means.

5. A toe-articulated stilt as in claim 4 wherein the distance between the first and third hinge means is equal to the distance between the second and fourth hinge means.

6. A toe-articulated stilt as in claim 5 wherein the distance between the first and eighth hinge means is equal to distance between the second and seventh hinge means.

7. A toe-articulated stilt as in claim 6 wherein the toecolumn, solecolumn, and heelcolumn are of equal length.

8. A toe-articulated stilt as in claim 1 wherein the heel holder means terminates rearwardly with adjustable upstanding wing means defined to adheringly surround the heel portion of a shoe of a wearer.

* * * * *